US009745100B2

(12) United States Patent
Baltz et al.

(10) Patent No.: US 9,745,100 B2
(45) Date of Patent: Aug. 29, 2017

(54) STACK AND FOLD DAIRY SHELVES

(71) Applicant: Rehrig Pacific Company, Los Angeles, CA (US)

(72) Inventors: Kyle L. Baltz, Rossmoor, CA (US); John B. Zelek, Los Angeles, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 14/837,607

(22) Filed: Aug. 27, 2015

(65) Prior Publication Data

US 2016/0185486 A1 Jun. 30, 2016

Related U.S. Application Data

(60) Provisional application No. 62/042,427, filed on Aug. 27, 2014.

(51) Int. Cl.
*B65D 21/08* (2006.01)
*A47F 3/14* (2006.01)
(Continued)

(52) U.S. Cl.
CPC ..... *B65D 21/086* (2013.01); *A47F 3/14* (2013.01); *B65D 11/1833* (2013.01); *B65D 19/0016* (2013.01); *B65D 21/0215* (2013.01); *A47B 87/0253* (2013.01); *B65D 2519/00034* (2013.01); *B65D 2519/00069* (2013.01); *B65D 2519/00129* (2013.01);
(Continued)

(58) Field of Classification Search
CPC ..... A47B 47/00; A47B 87/0253; A47B 5/00; A47B 57/58; A47F 3/14; B65D 6/16; B65D 19/00; B65D 19/0004; B65D 19/18; B65D 21/02; B65D 21/0209; B65D 21/032; B65D 21/08; B65D 21/086; B65D 85/80; B65D 2519/00796; B65D 6/12; B65D 11/1833; B65D 19/0016; B65D 21/0215
USPC ..... 206/386, 503–509, 600, 736, 743, 744; 220/1.5, 6
See application file for complete search history.

(56) References Cited

U.S. PATENT DOCUMENTS 4,917,255 A * 4/1990 Foy ..... B65D 25/005 206/503
5,515,987 A * 5/1996 Jacques ..... B65D 11/1833 220/6
(Continued)

*Primary Examiner* — Bryon Gehman
(74) *Attorney, Agent, or Firm* — Carlson, Gaskey & Olds PC

(57) ABSTRACT

A shelving system includes a plurality of collapsible containers stacked on one another and on a pallet or dolly. Each collapsible container includes a base and a pair of opposed side walls pivotably connected to the base and movable between an upright position and a collapsed position on the base. Each collapsible container further includes a rear wall pivotably connected to the base and movable between an upright position and a collapsed position on the base. The rear wall may include a pair of opposed flange portions with a lower central portion therebetween. A front wall is pivotably connected to the base opposite the rear wall and is movable between an upright position and a retracted position outward of the container. The pallet accommodates the stack of collapsible containers and has thin outer columns so that the shelving system can fit into existing store refrigerators.

23 Claims, 20 Drawing Sheets

(51) Int. Cl.

| | |
|---|---|
| ***B65D 6/18*** | (2006.01) |
| ***B65D 19/00*** | (2006.01) |
| ***B65D 21/02*** | (2006.01) |
| *A47B 87/02* | (2006.01) |

(52) U.S. Cl.

CPC ..... *B65D 2519/00268* (2013.01); *B65D 2519/00288* (2013.01); *B65D 2519/00318* (2013.01); *B65D 2519/00333* (2013.01); *B65D 2519/00442* (2013.01); *B65D 2519/00796* (2013.01)

(56) References Cited

U.S. PATENT DOCUMENTS 5,746,342 A * 5/1998 Jacques ..... B65D 11/1833 220/6
5,918,743 A * 7/1999 Uitz ..... B65D 11/1833 220/7
6,398,054 B1 * 6/2002 Overholt ..... B65D 1/0223 220/669
6,601,724 B1 * 8/2003 Koefelda ..... B65D 25/005 220/4.28
6,708,836 B2 * 3/2004 Zelko ..... B65D 11/1833 220/7
6,776,300 B2 * 8/2004 Walsh ..... B65D 19/18 220/6
7,484,634 B2 * 2/2009 Apps ..... B65D 19/18 220/6
8,434,618 B2 * 5/2013 Mitchell ..... B65D 19/06 220/7
8,602,240 B1 * 12/2013 Laurita ..... B65D 11/18 220/4.28
8,757,412 B2 * 6/2014 Sommer ..... B65D 11/1833 220/4.28
2008/0169285 A1 * 7/2008 Marazita ..... B65D 19/18 220/6
2013/0087477 A1 * 4/2013 Kuhn ..... B65D 71/14 206/563

* cited by examiner

STACK AND FOLD DAIRY SHELVES

BACKGROUND

Consumer items such as containers of milk may be shipped to the store in crates or boxes, where store workers unload the containers of milk onto shelves. Consumers remove the milk containers from the shelves to purchase them. Store workers periodically rearrange and reload the shelves with more milk containers.

SUMMARY

A shelving system includes a plurality of collapsible containers stacked on one another and on a pallet or dolly. Each collapsible container includes a base and a pair of opposed side walls pivotably connected to the base and movable between an upright position and a collapsed position on the base. Each collapsible container further includes a rear wall pivotably connected to the base and movable between an upright position and a collapsed position on the base. The rear wall may include a pair of opposed flange portions with a lower central portion therebetween. A front wall is pivotably connected to the base opposite the rear wall and is movable between an upright position and a retracted position outward of the container. The pallet accommodates the stack of collapsible containers and has thin outer columns so that the shelving system can fit into existing store refrigerators.

The shelving system may be used to ship containers of milk or other items to stores. The shelving system can be placed directly into the store refrigerator and the consumers can select the items from the shelving system. As the containers are removed, store workers can move a few remaining items from the rear of the top container and place them into a lower container, again working from the rear (e.g. in the refrigerator). As the upper containers are emptied, they can also be collapsed from the rear, removed from the stack and stacked efficiently in the collapsed position until they are returned to the warehouse or distribution facility for reuse.

DETAILED DESCRIPTION OF A PREFERRED EMBODIMENT

Figure 1:
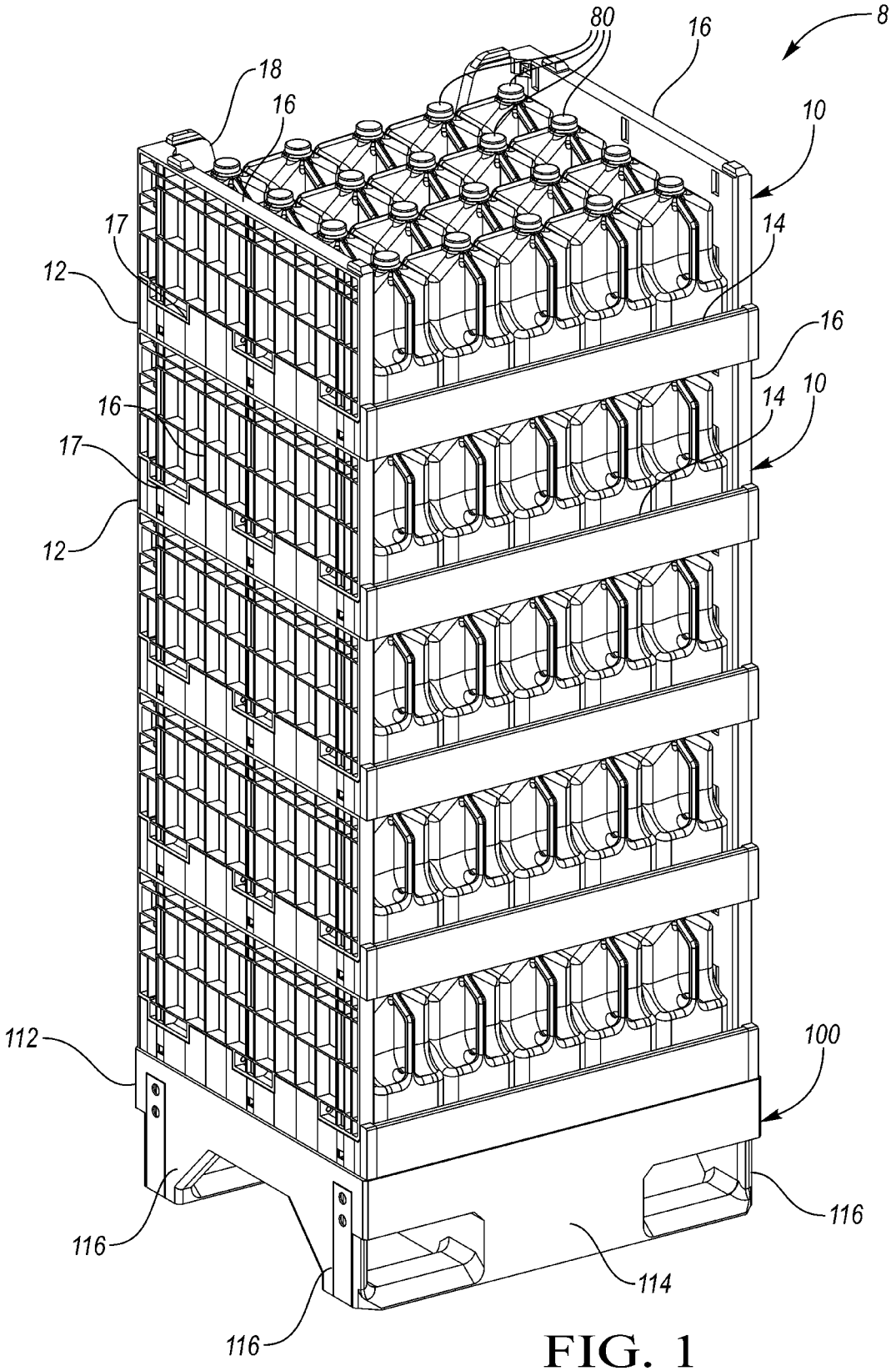
FIG. 1 is a perspective view of a shelving system according to one embodiment.

A shelving system 8 according to one embodiment is shown in FIG. 1. The shelving system 8 includes a plurality stackable collapsible containers 10 stacked on one another and on a pallet 100. Each of the collapsible containers 10 includes a base 12 having a low front wall 14 and high side walls 16. The side walls 16 are hingeably connected to side flanges 17 that project upward from side edges of the base 12 and are formed integrally with the base 12. A rear wall 18 extends upward from a rear edge of the base 12 and connects rear edges of the side walls 16.

A plurality of items 80, such as plastic milk jugs 80 are stored in each container 10. The items 80 are supported by the base 12 and disposed between side walls 16 and between the front wall 14 and rear wall 18. The side walls 16 are taller than the items 80, such that the weight of these stacked containers 10 is supported on containers 10, not the items 80.

The pallet 100 generally includes a deck 112 supported above the floor by a central support 114 and outer columns 116.

Figure 2:
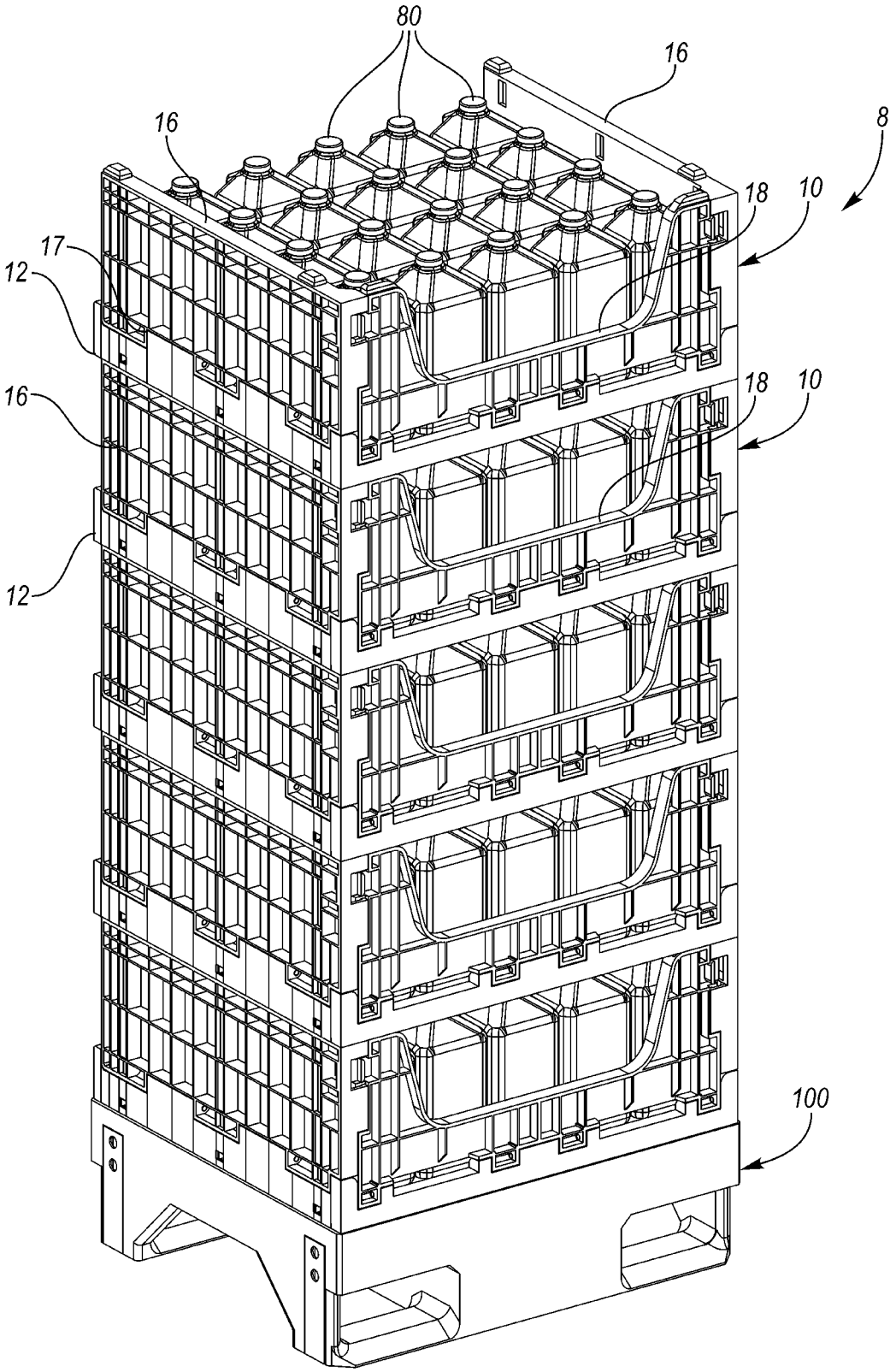
FIG. 2 is a rear perspective view of the shelving system of FIG. 1.

FIG. 2 is a rear view of the shelving system 8 of FIG. 1.

Figure 3:
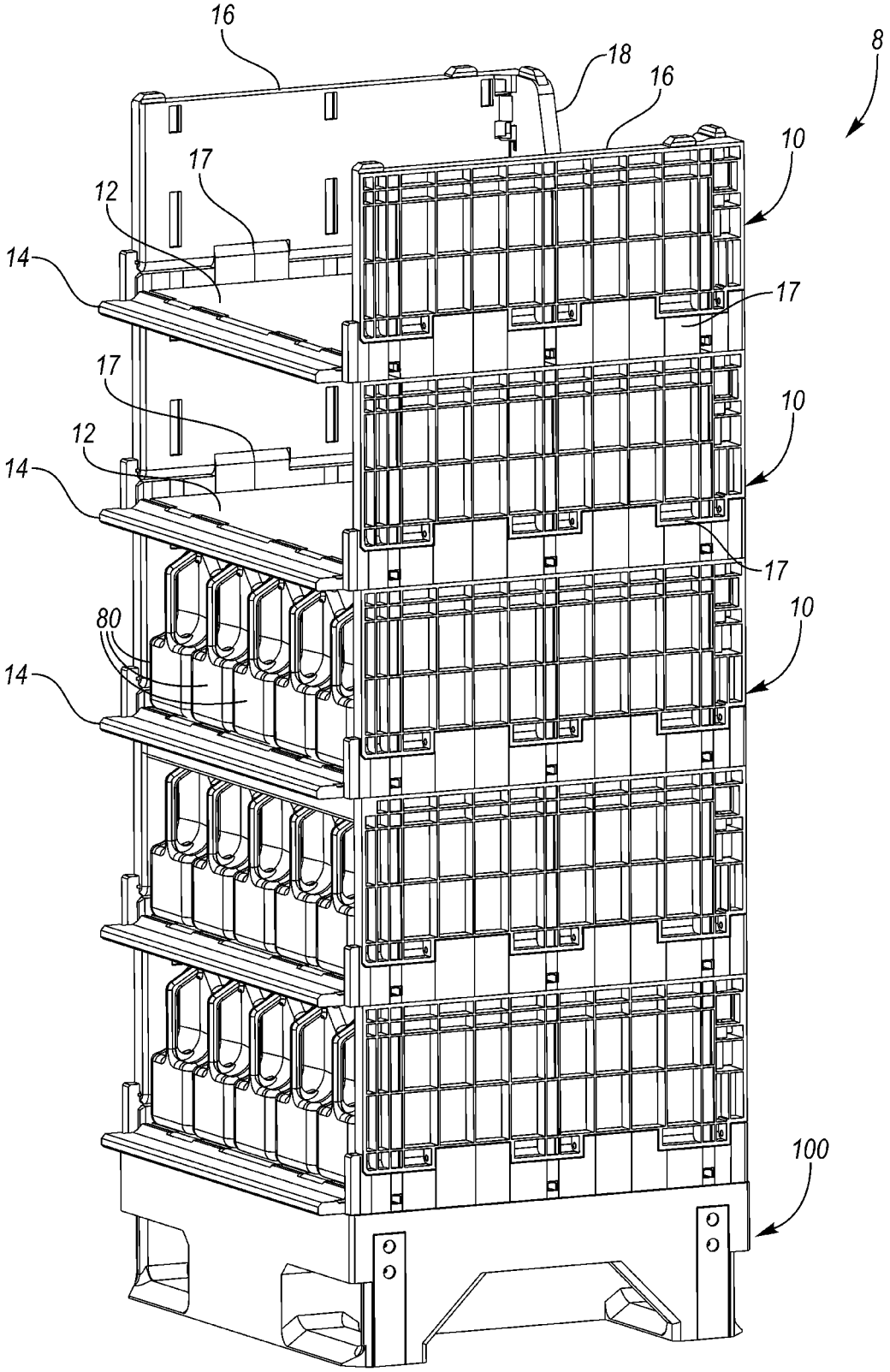
FIG. 3 shows the shelving system during loading.

FIG. 3 shows the shelving system 8 during loading. The front walls 14 of the container 10 are pivoted downward and outward to an open position, generally in the same plane as the base 12. Latches (not shown) are selectively released to disconnect the front wall 14 from the side flanges 17. With the front wall 14 open, a plurality of items can be loaded onto the container 10, such as by sliding all of them onto the base 12 over the front wall 14. This can be performed by automated handling equipment. The front walls 14 are then pivoted to the upright position and latched in place. Preferably the front wall 14 is latched to the side flanges 17 in a manner that would not be obvious or accessible to the consumer to unlatch. For example, a latch or locking mechanism that is accessible only from the sides of the shelving system 8 could secure the front wall 14 to the side walls 16 but would not be accessible to the consumers because the shelving systems would be stacked next to one another, covering the latch or locking system.

Figure 4:
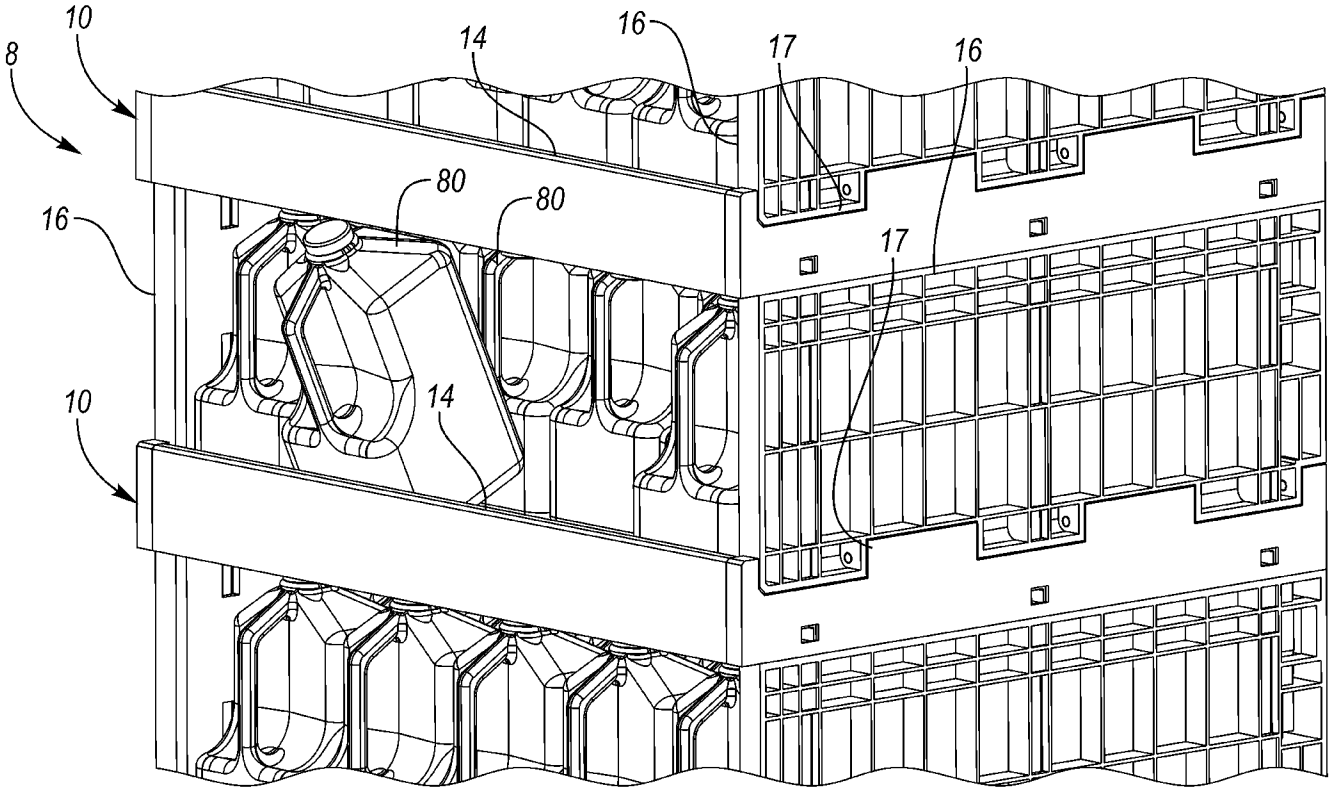
FIG. 4 shows an item being removed from the front of one of the containers of the shelving system.

In FIG. 4, the front walls 14 are shown in the upright, latched position. The shelving system 8 is moved into position in a store refrigerator, with the front wall facing the doors of the refrigerator. A consumer can remove the items 80 through the front opening in the container 10 over the front wall 14, even below another container 10. In this particular embodiment, the front wall 14 is less than one-third the height of the side walls 16, which retains the items 80 in the container 10, but permits the consumer to remove the items 80 as shown.

Figure 5:
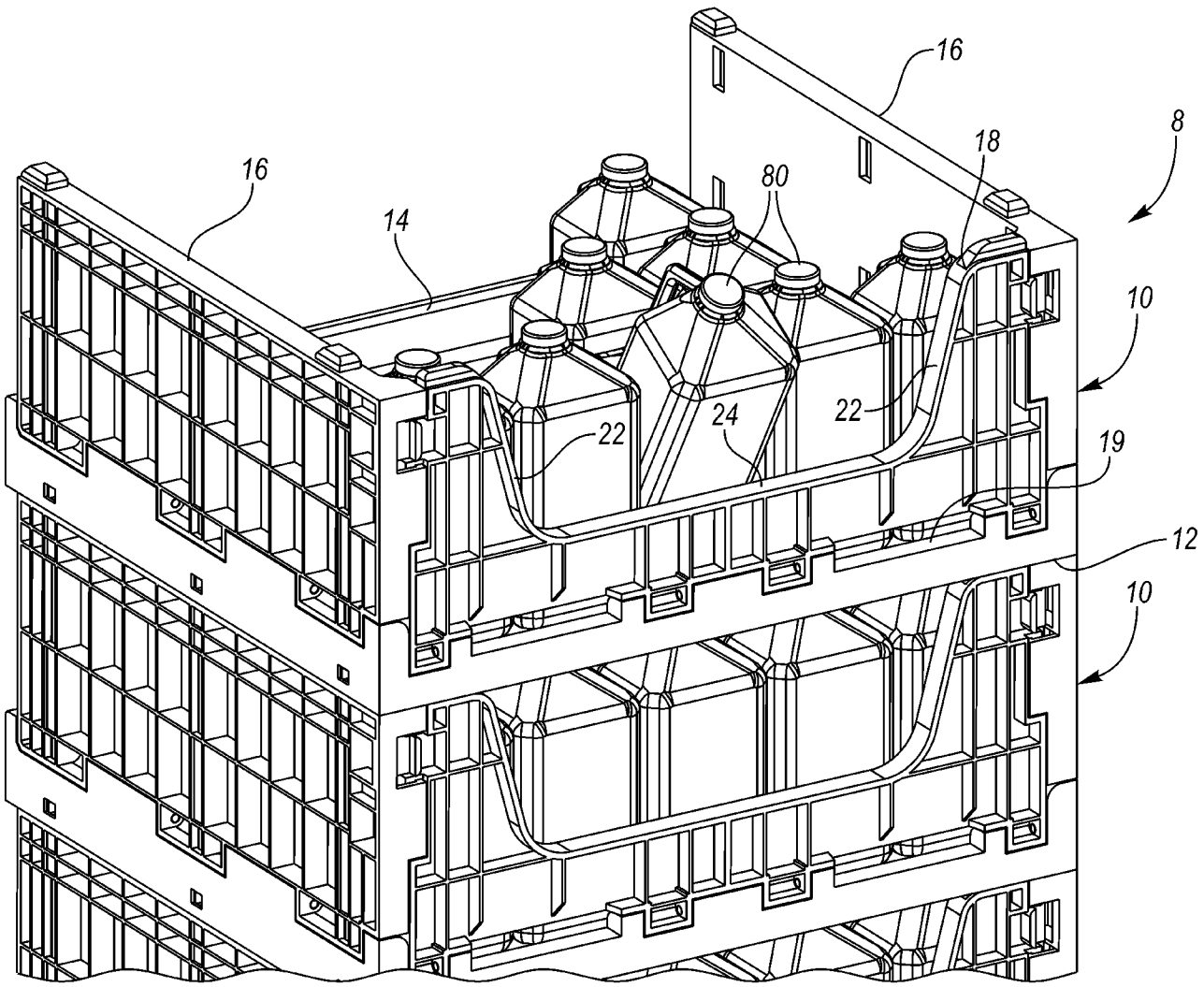
FIG. 5 is a rear view of the shelving system after some items have been removed.

FIG. 5 is a rear view of the shelving system 8 after some of the items 80 have been removed from the upper container 10 by customers. In the refrigerator at the store, the shelving system 8 would be accessible to the workers from the rear. When consumers have removed items 80 from the front of the upper container 10 and from the front of the second container 10, store workers can remove items 80 from the upper container and insert them from the rear into the second container 10, sliding the existing items 80 forward into the second container 10. As shown in FIG. 5, the rear wall 18 contains a lower central portion 24 and higher side flanges 22. The side flanges 22 provide support to the side walls 16, while the lower central portion 24 permits the workers to remove the items 80 from the upper container 10 and to insert the items 80 back into the second container 10 from the rear. The lower central portion 24 is less than half the height of the higher side flanges 22 and in this particular embodiment is approximately one-third the height of the higher side flanges 22.

Figure 6:
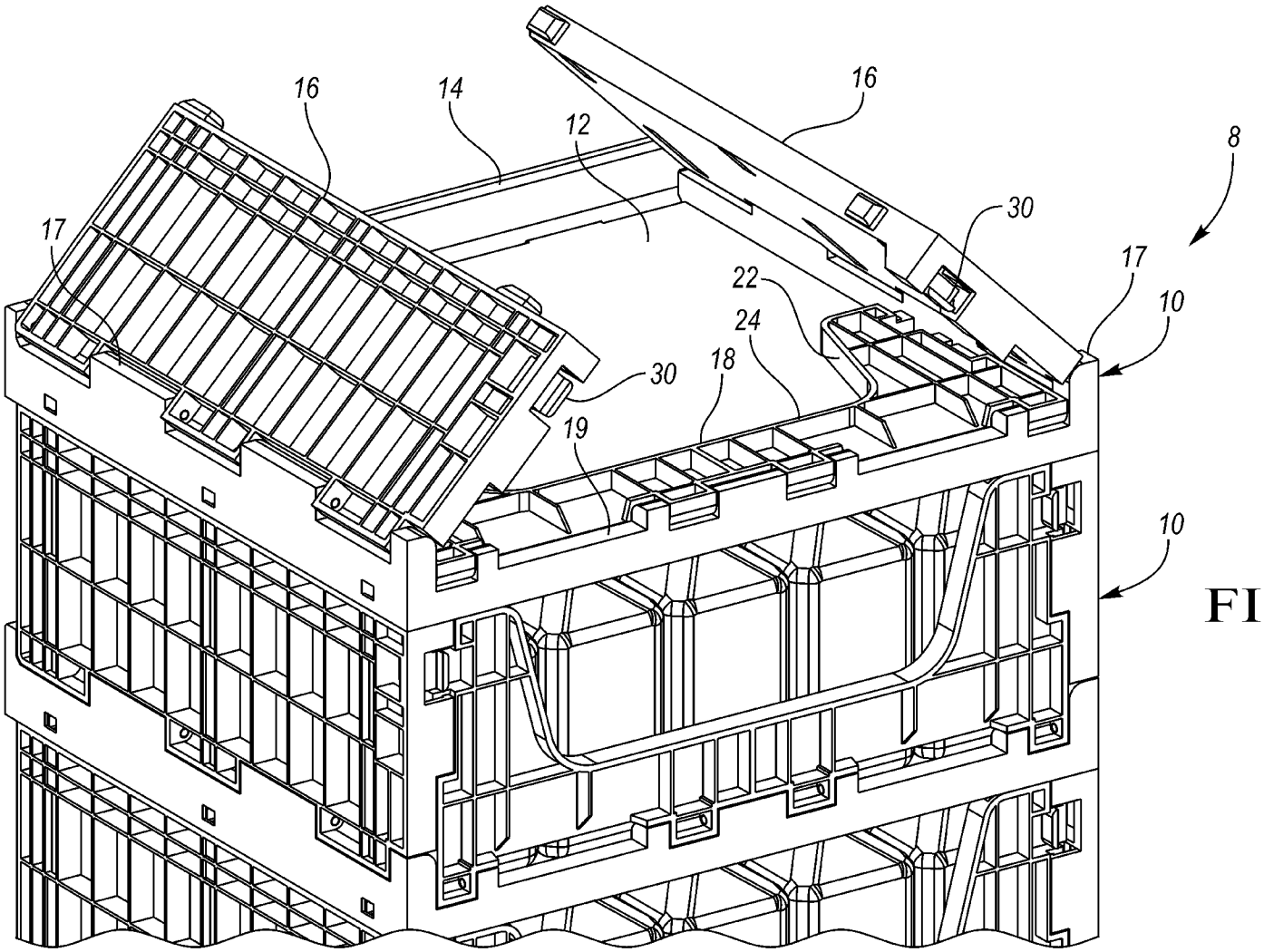
FIG. 6 shows the shelving system of FIG. 5 with the empty top container being collapsed.

Referring to FIG. 6, after the items 80 have been removed from the upper container 10, the worker can then collapse the uppermost container 10 in place, operating completely from the rear of the shelving system 8. The operator releases the latches 30 on side walls 16 so that the rear wall 18 can be collapsed inward, downward onto the base 12. As shown, the rear wall 18 is hingeably connected to a short rear flange 19 formed integrally with the base 12. The side walls 16 can then be collapsed downward onto the rear wall 18. The upper container 10 can then be removed by the worker from the rear of the shelving system 8 to facilitate users removing items from the second container 10. Note that the front wall 14 remains in the upright position.

Figure 7:
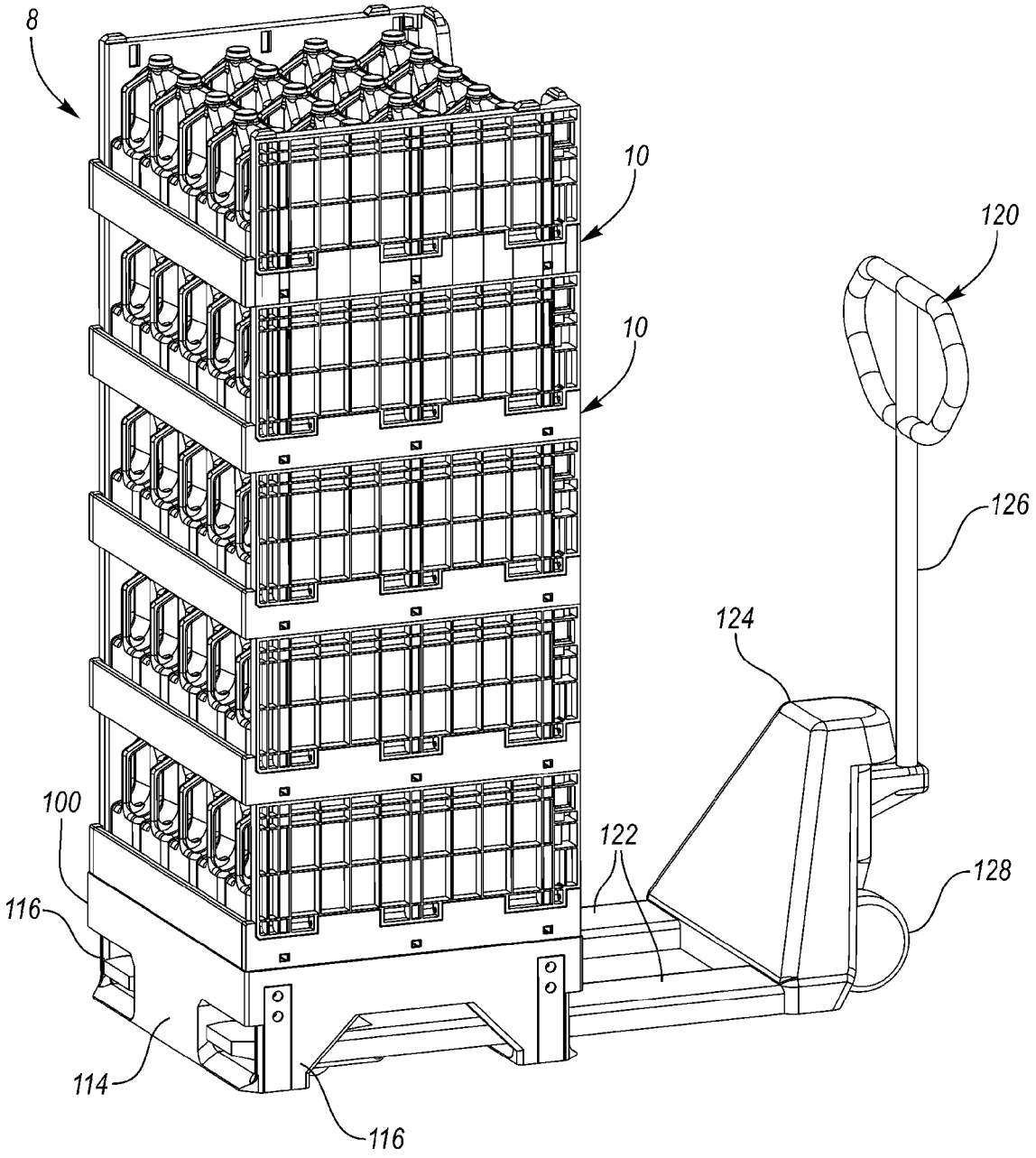
FIG. 7 shows the shelving system on a pallet jack.

FIG. 7 shows the shelving system 8, including the plurality of containers 10 stacked on the pallet 100, being moved by a pallet jack 120. The pallet jack 120 includes a pair of fork tines 122 extending from a lift mechanism 124 supported by wheels 128. A handle 126 permits the operator to move the pallet lift jack 120 and the shelving system 8. The tines 122 are received in the openings between the central support 114 and the outer columns 116 of the pallet 100.

Figure 8:
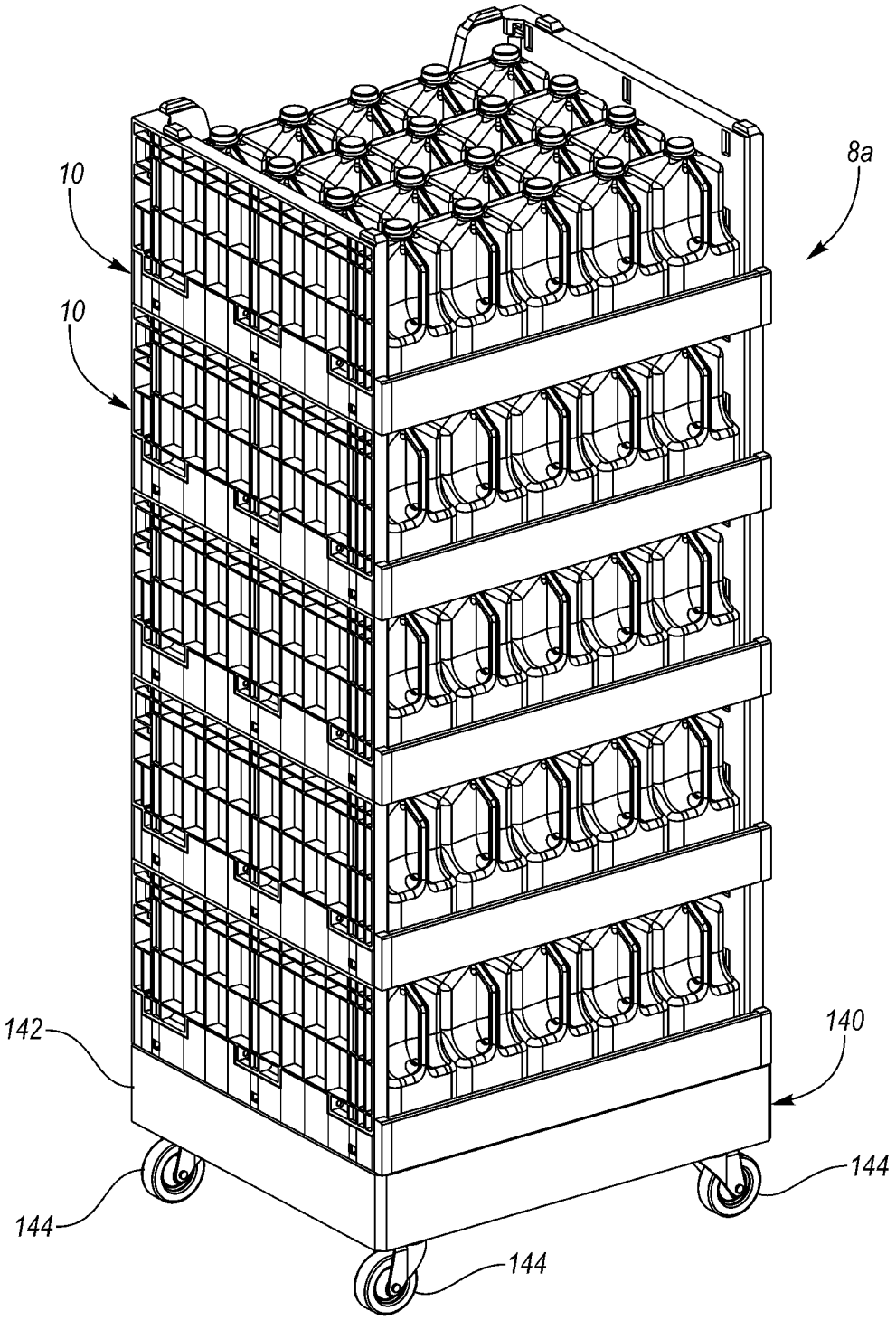
FIG. 8 shows an alternate shelving system in which the containers are supported on a dolly having casters.

FIG. 8 shows an alternate shelving system 8Λ in which the containers 10 are stacked on a dolly 140 having a deck 142 supported by casters 144.

Figure 9:
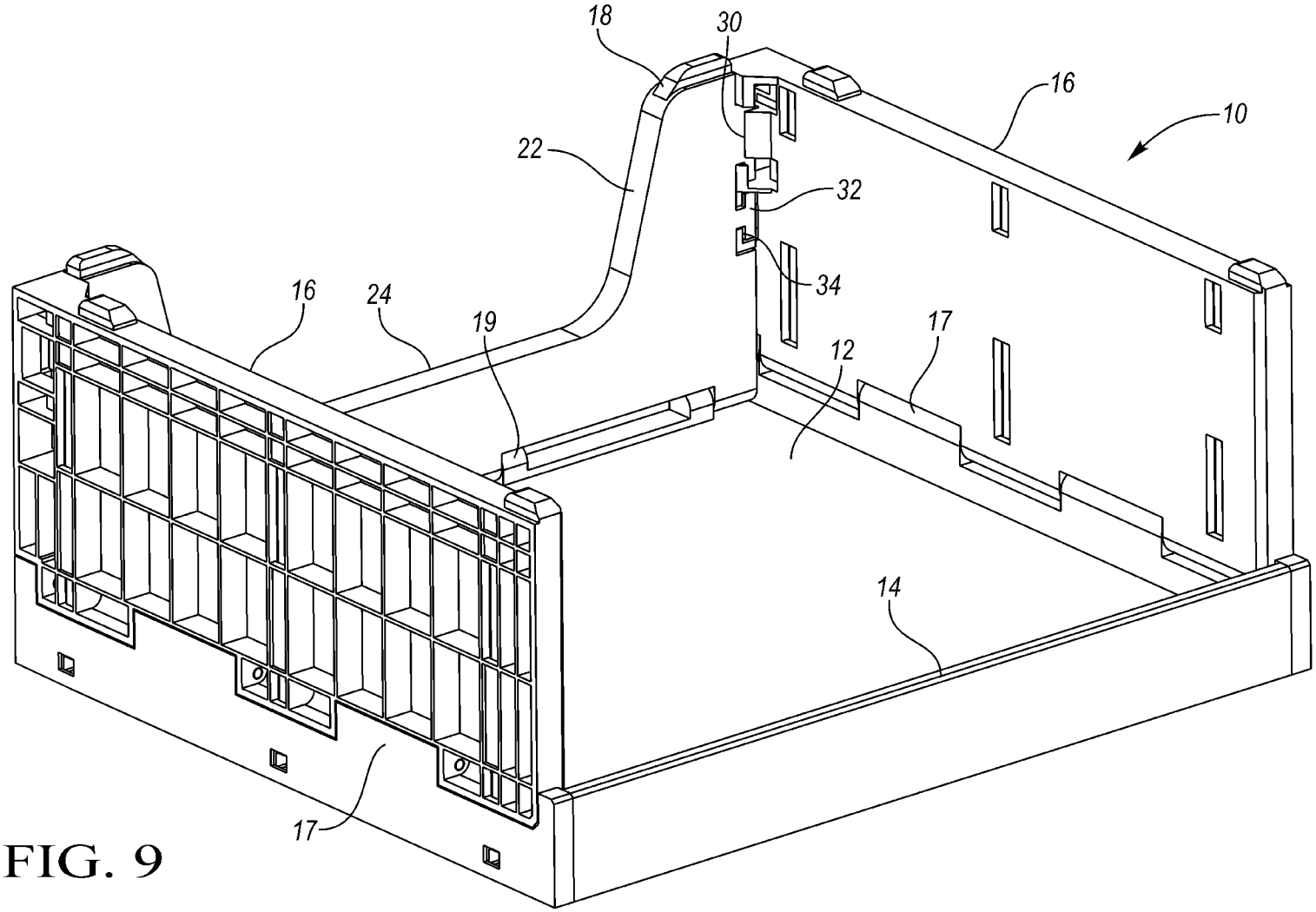
FIG. 9 is a front perspective view of one of the containers of the shelving system of FIG. 1.

FIG. 9 is a front perspective view of one of the containers 10. Again each container 10 includes the base 12 having upstanding side flanges 17 extending upward from side edges of the base 12 and a rear flange 19 extending upward form a rear edge of the base 12. The side flanges 17 and rear flange 19 are formed integrally with the base 12. The short front wall is pivotably connected to a front edge of the base 12. The side walls are pivotably connected to the side flanges 17. The rear wall 18 is pivotably connected to the rear flange 19 and is latched to rear edges of the side walls 16 by a latch 30 on the side wall 16 and interlocking members 32, 34 formed on the rear wall 18 and side wall 16 respectively. Each of the base 12, side walls 16, rear wall 18 and front wall 14 is injection molded as a single piece of plastic, although the side walls 16 and base 12 may have reinforcement, as explained below.

Figure 10:
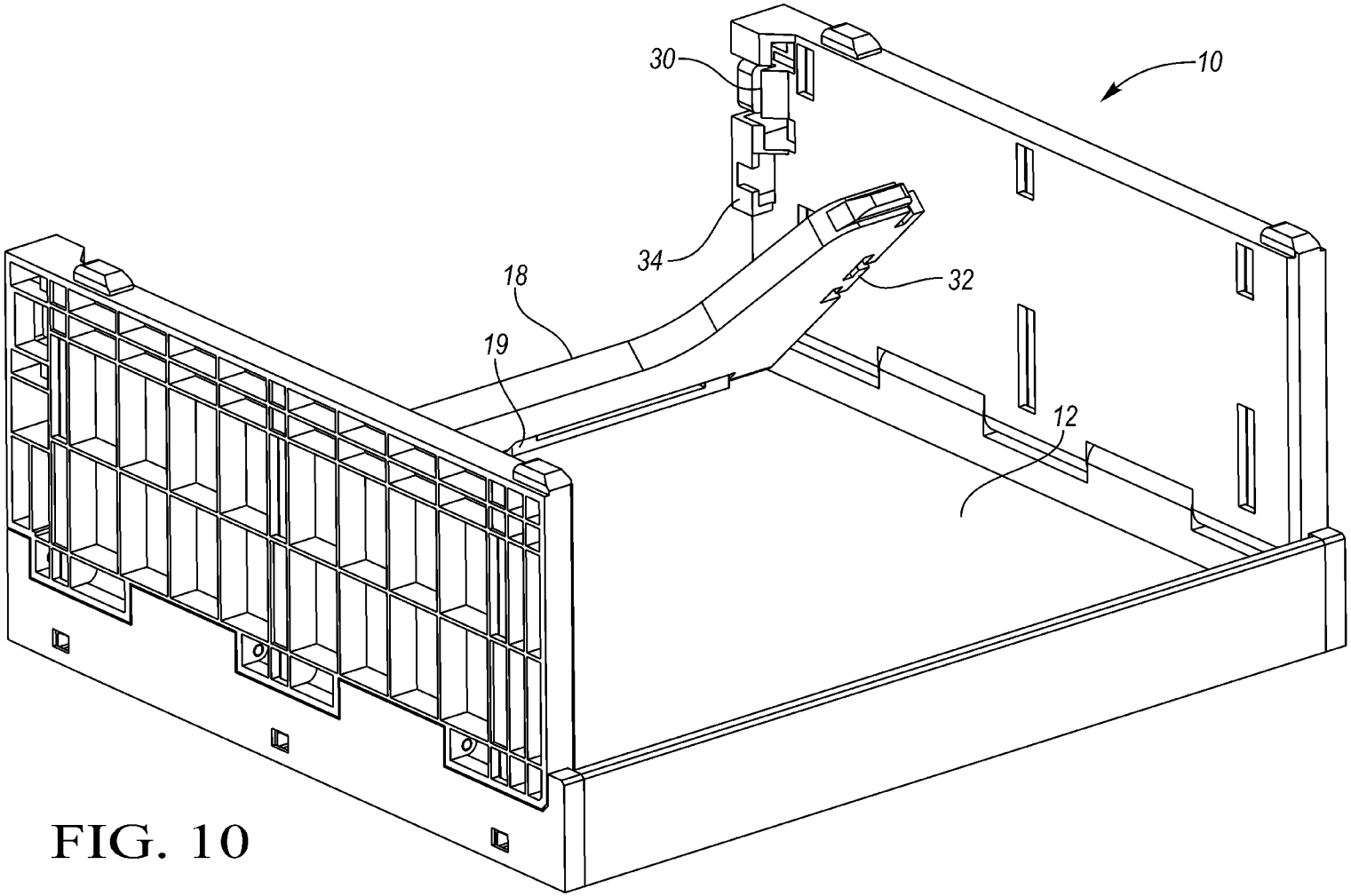
FIG. 10 shows the container of FIG. 9 with the rear wall being collapsed.

In FIG. 10, the rear wall 18 is being collapsed after release of the latch 30. The rear wall 18 is pivoting downward relative to the rear flange 19.

Figure 11:
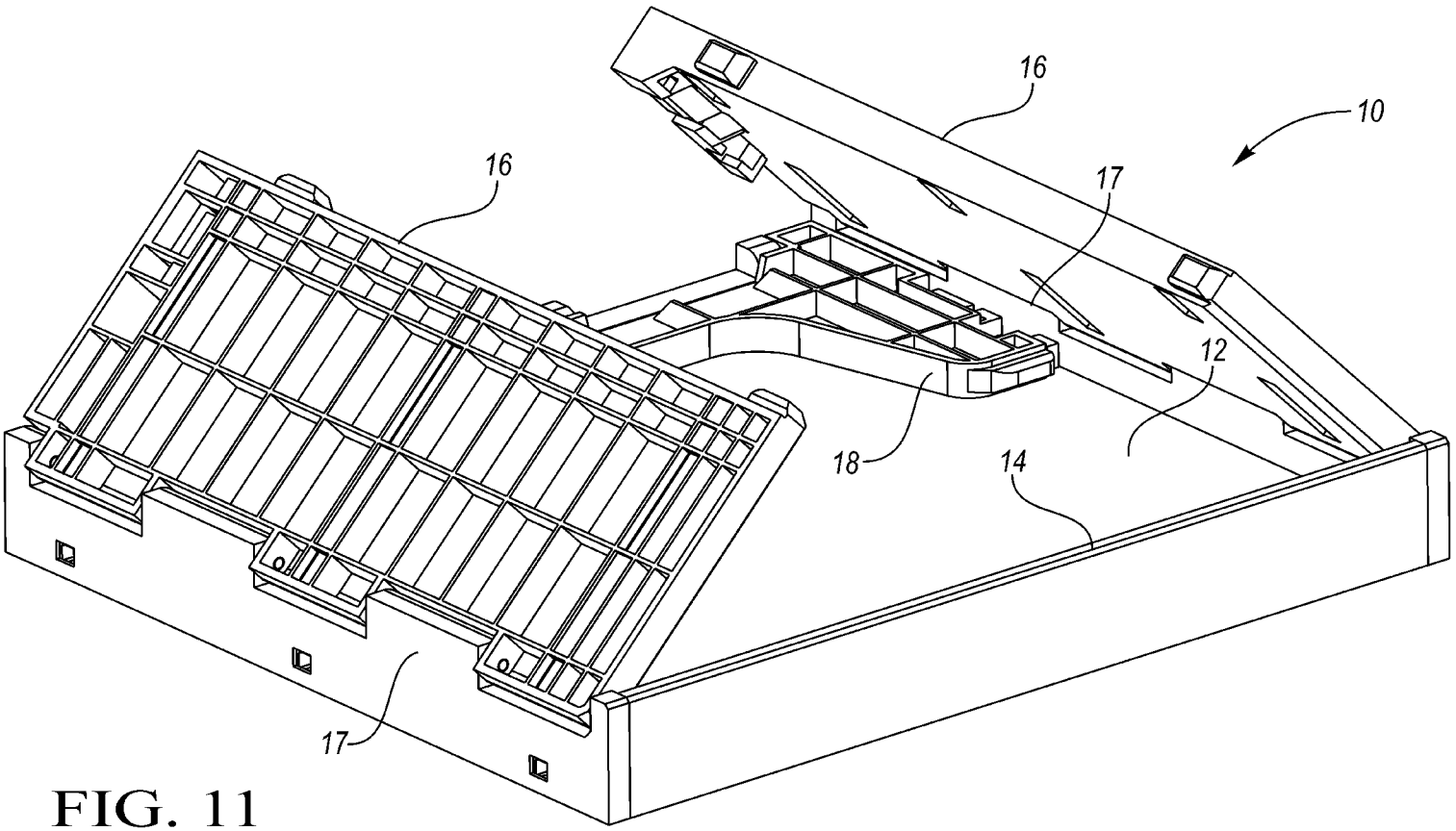
FIG. 11 shows the container of FIG. 9 with the rear wall and side walls being collapsed.

In FIG. 11, the rear wall 18 is collapsed onto the base 12 below the side flanges 17. The side walls 16 are being pivoted downward relative to the side flanges 17 onto the rear wall 18.

Figure 12:
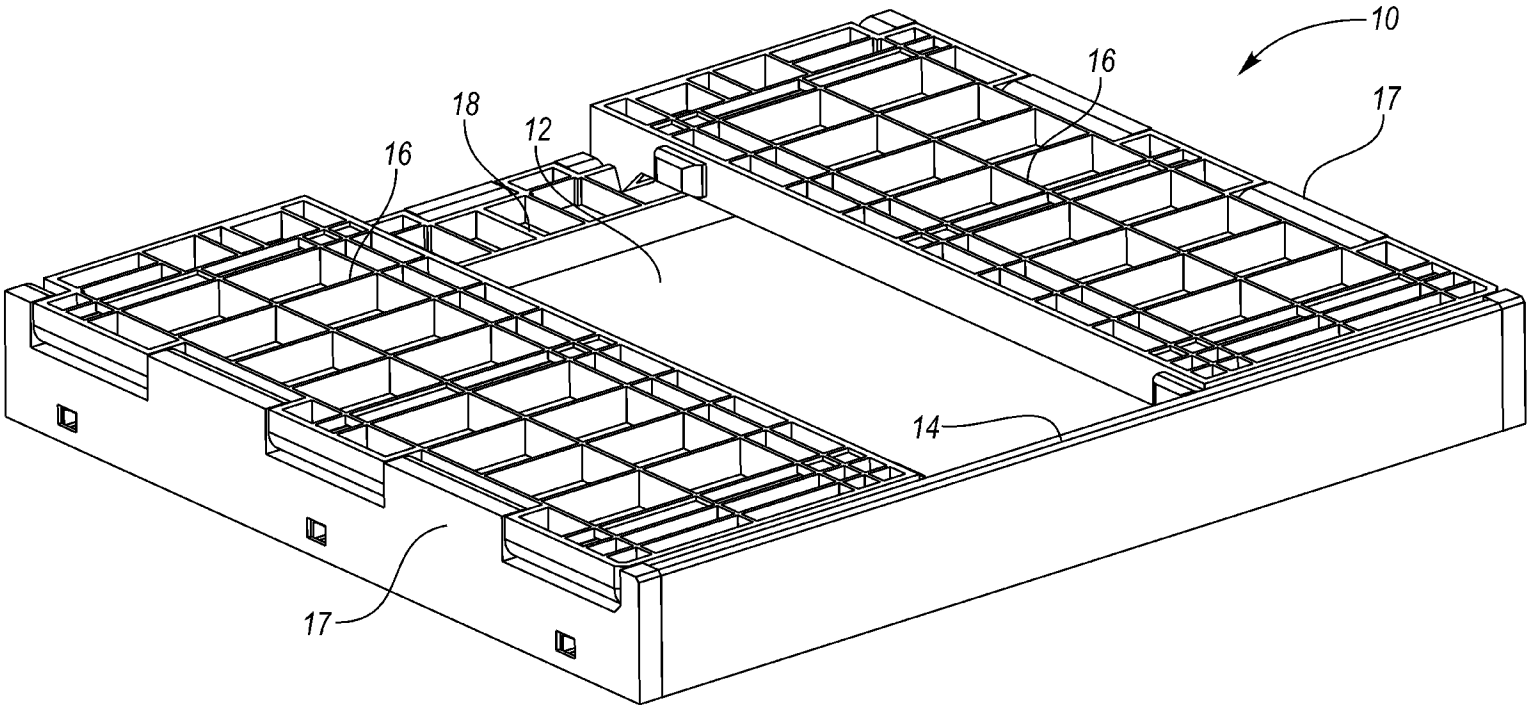
FIG. 12 shows the container of FIG. 9 in the collapsed position.
Figure 13:
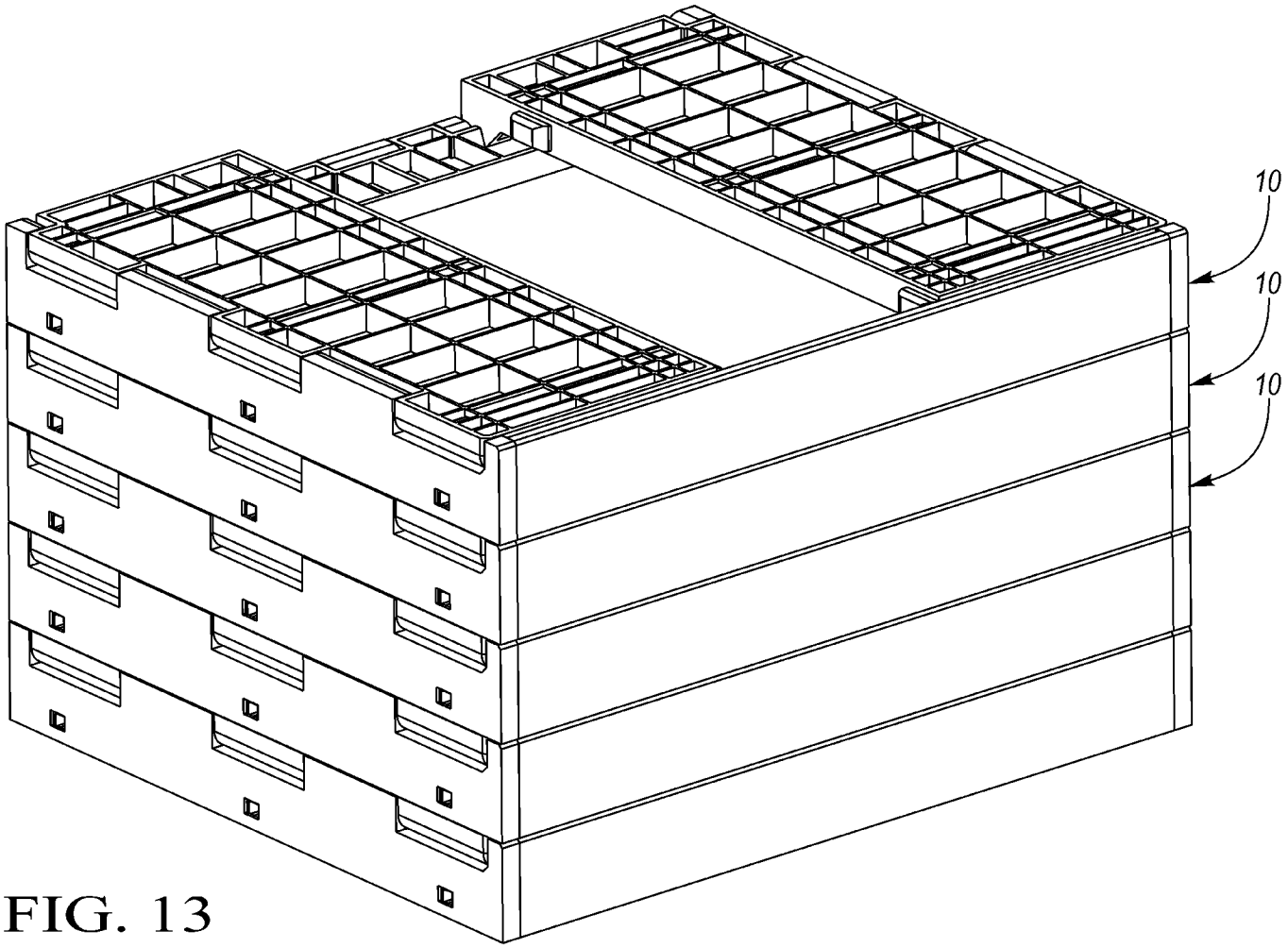
FIG. 13 shows the containers of FIG. 1 in the collapsed position stacked on one another.

FIG. 12 shows the container 10 in a collapsed position. As shown, the side walls 16 in the collapsed position are fairly flush or coplanar with the upper edge of the front wall 14, which does not need to be retracted or collapsed. As shown in FIG. 13, a plurality of the collapsed containers 10 can be stacked on one another for efficient storage and shipping, such as when the empty containers 10 are returned to a warehouse or distribution center for reuse.

Figure 14:
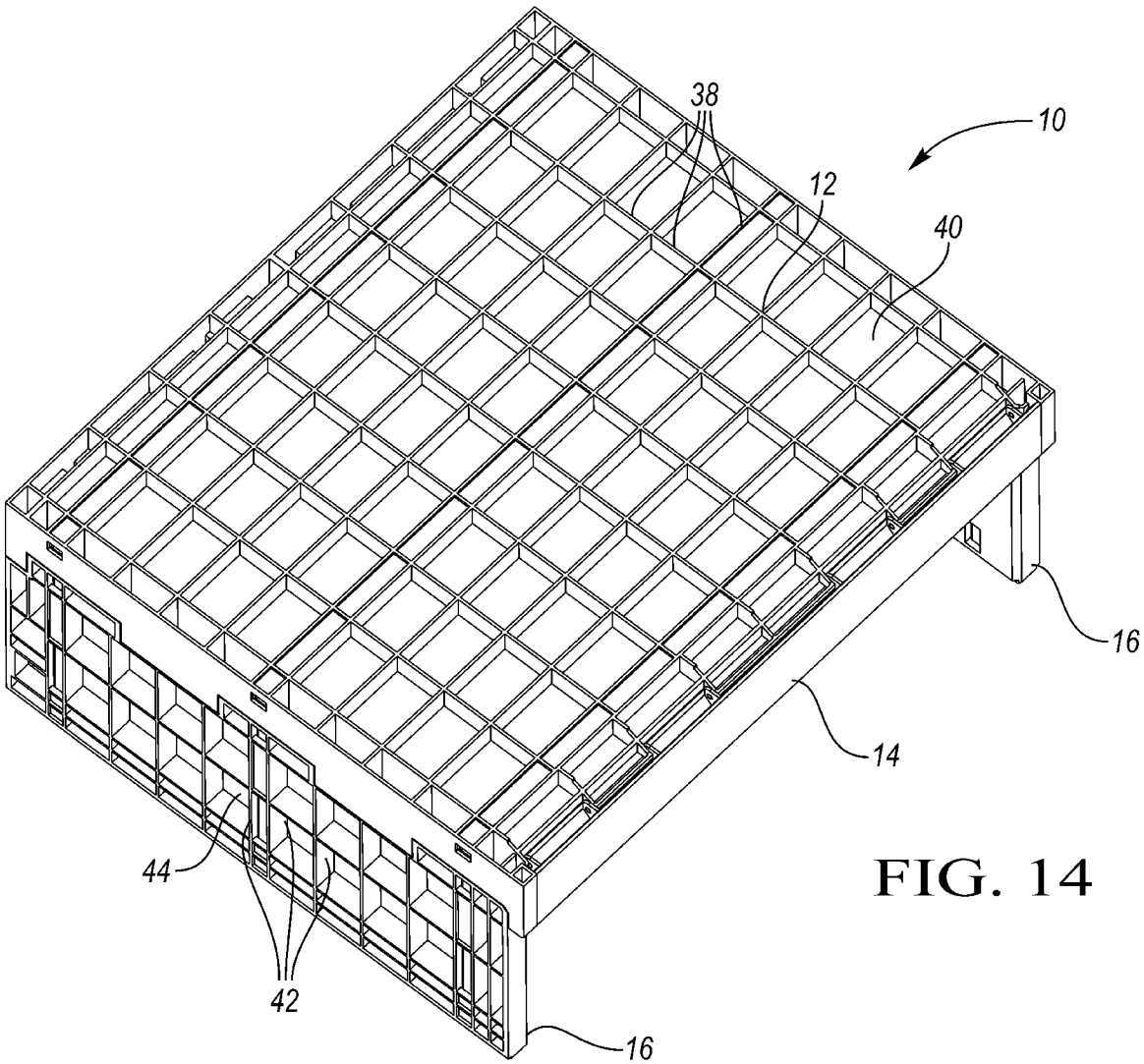
FIG. 14 is a bottom perspective view of one of the containers.

FIG. 14 is a bottom perspective view of one of the containers 10. The base 12 includes a generally planar portion 40 having a plurality of intersecting ribs 38 extending downwardly therefrom. Similarly, the side walls 16 each include a planar portion 44 and a plurality of ribs 42 projecting outwardly therefrom.

Figure 15:
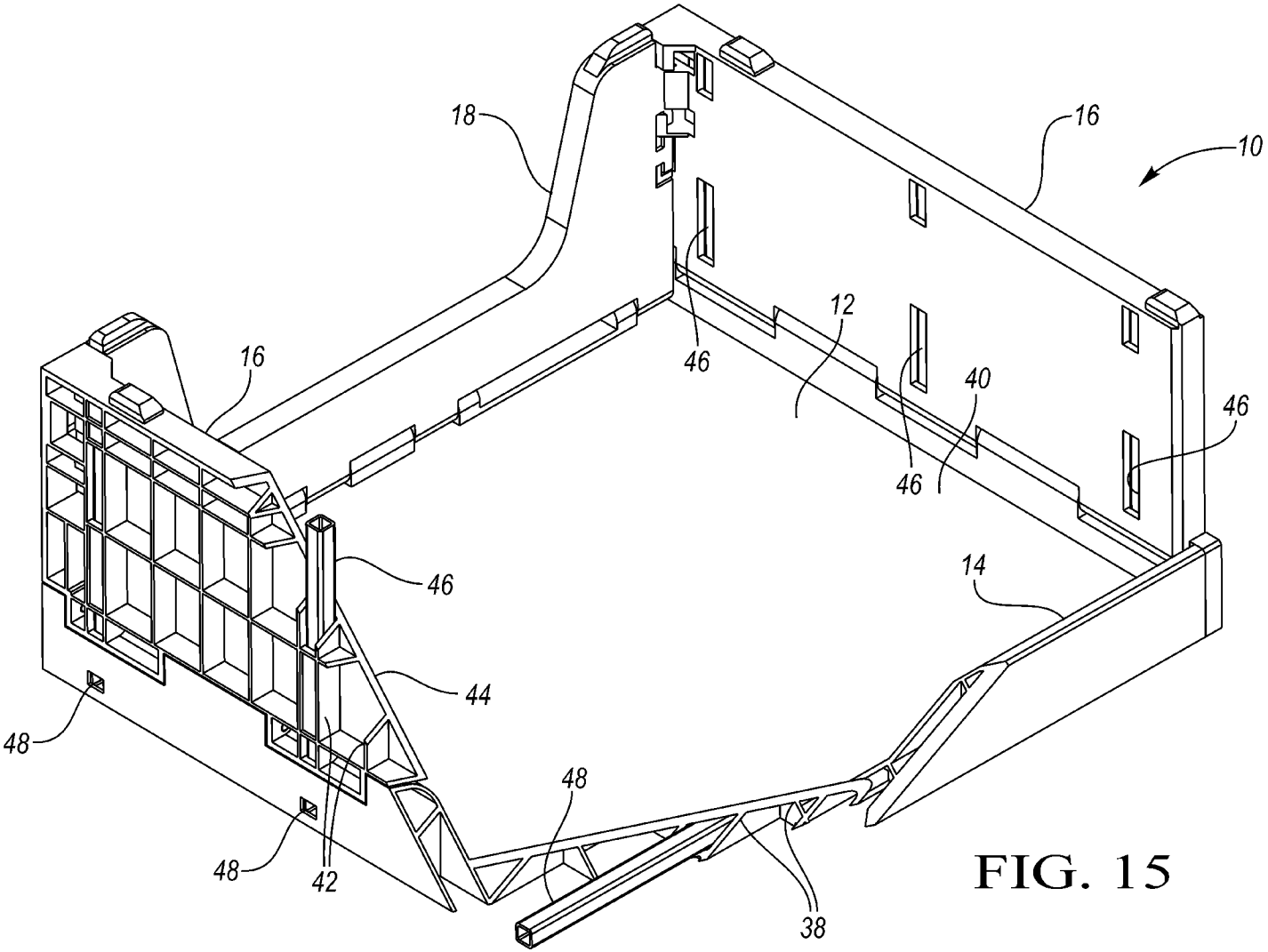
FIG. 15 shows the container partially broken away to illustrate an optional reinforcement member in the side wall.

FIG. 15 shows the container 10 partially broken away to illustrate a reinforcement member 46 in the side wall 16, captured between the plurality of ribs 42. In the embodiment shown, there are three such reinforcement members 46 oriented vertically within each side wall 16. The reinforcement members 46 may be metal, such as steel or aluminum, or maybe a stronger, stiffer composite plastic material. In the embodiment shown, the reinforcement members 46 are tubular, with a rectangular (specifically, square) cross-section. Similarly, a plurality of reinforcement members 48 reinforce the base 12, between the ribs 38. In this example, there are three such reinforcement members 48 in the base 12. The reinforcement members 48 may also be metal or a composite plastic.

Figure 16:
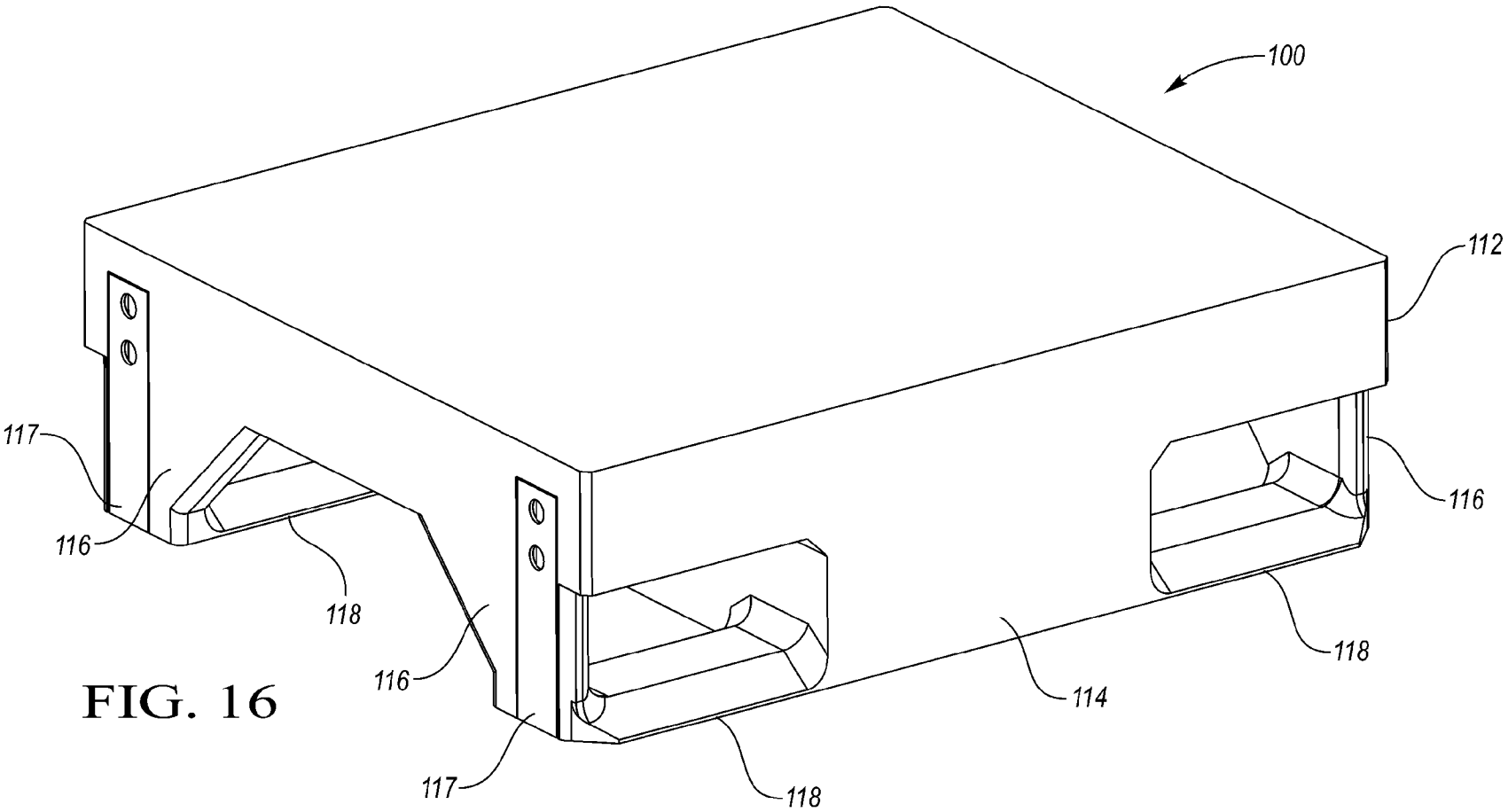
FIG. 16 is a perspective view of the pallet.
Figure 17:
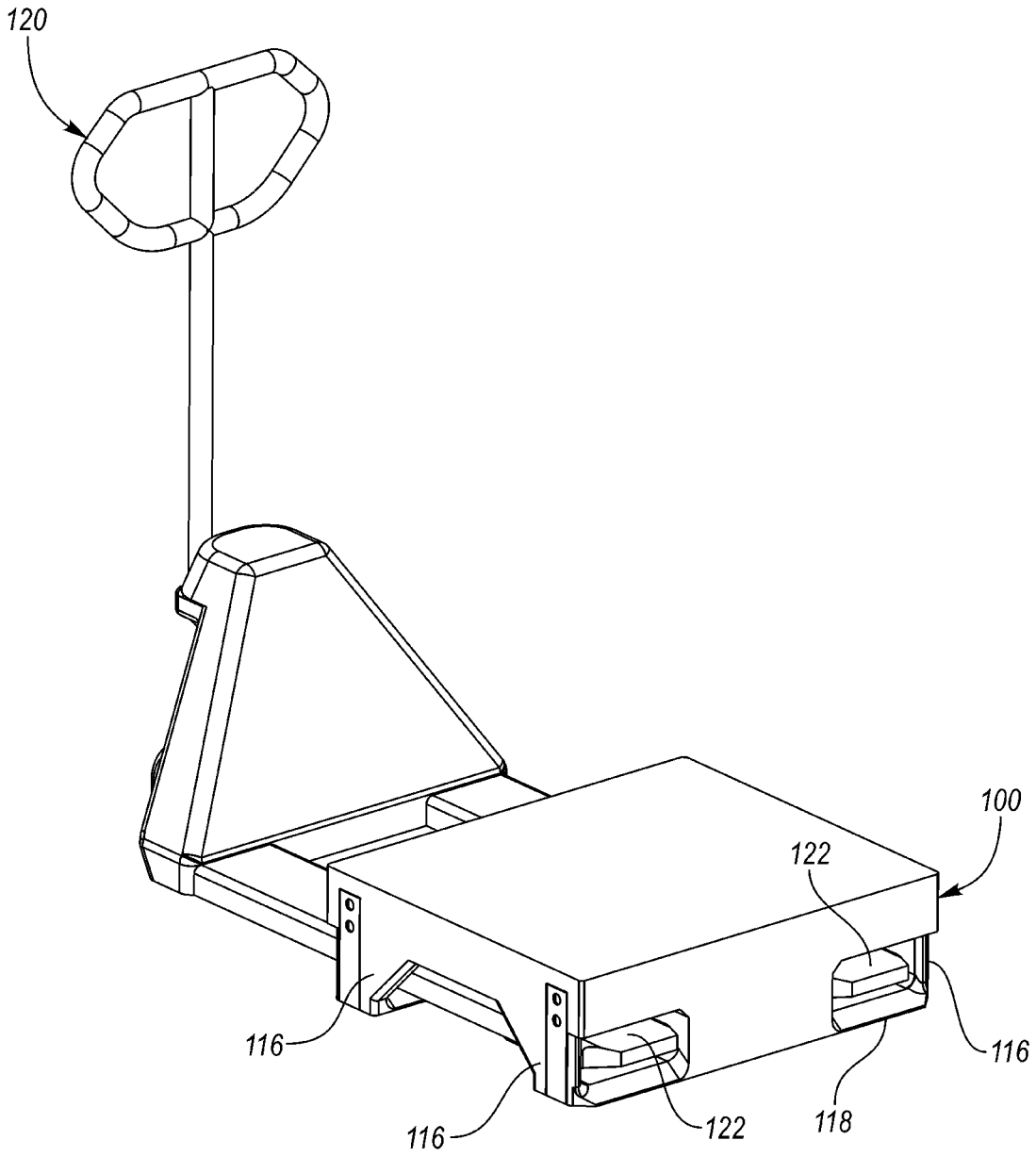
FIG. 17 is a perspective view of the pallet with a lift jack.
Figure 18:
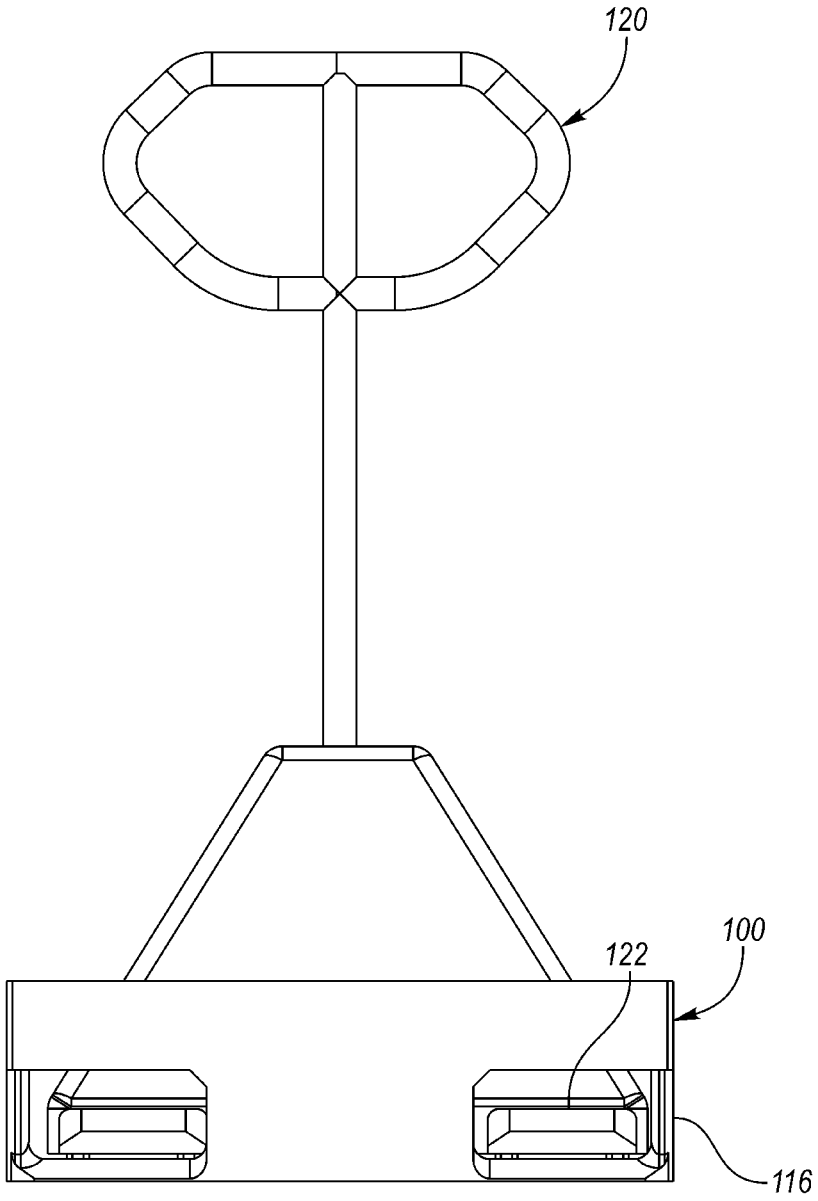
FIG. 18 is a front view of the pallet and lift jack of FIG. 17.

FIG. 16 is a perspective view of the pallet 100. The pallet 100 includes the deck 112 supported by the central support 114 and outer columns 116. Runners 118 may connect the lower ends of the outer columns 116 to the central support 114. The deck 112, central support 114, outer columns 116 and runners 118 may be injection molded or rotationally molded as a single piece of plastic. The outer columns 116 are very thin, in this example approximately 1 inch, in order to let the pallet 100 fit into certain store refrigerators. The outer columns 116 are reinforced with metal reinforcement members 115, which in this case are generally "U-shaped" (alternatively, L-shaped) brackets, the upper portions of which are received in recesses on the outer surfaces of the outer columns 116. Since the dimensions of the tines 122 of the pallet lift jack 120 (FIGS. 17-18) are already determined, this leaves very little thickness available for the outer columns 116, so the reinforcement members 115 provide increased strength to the outer columns 116 and increased stability for the pallet 100.

Figure 19:
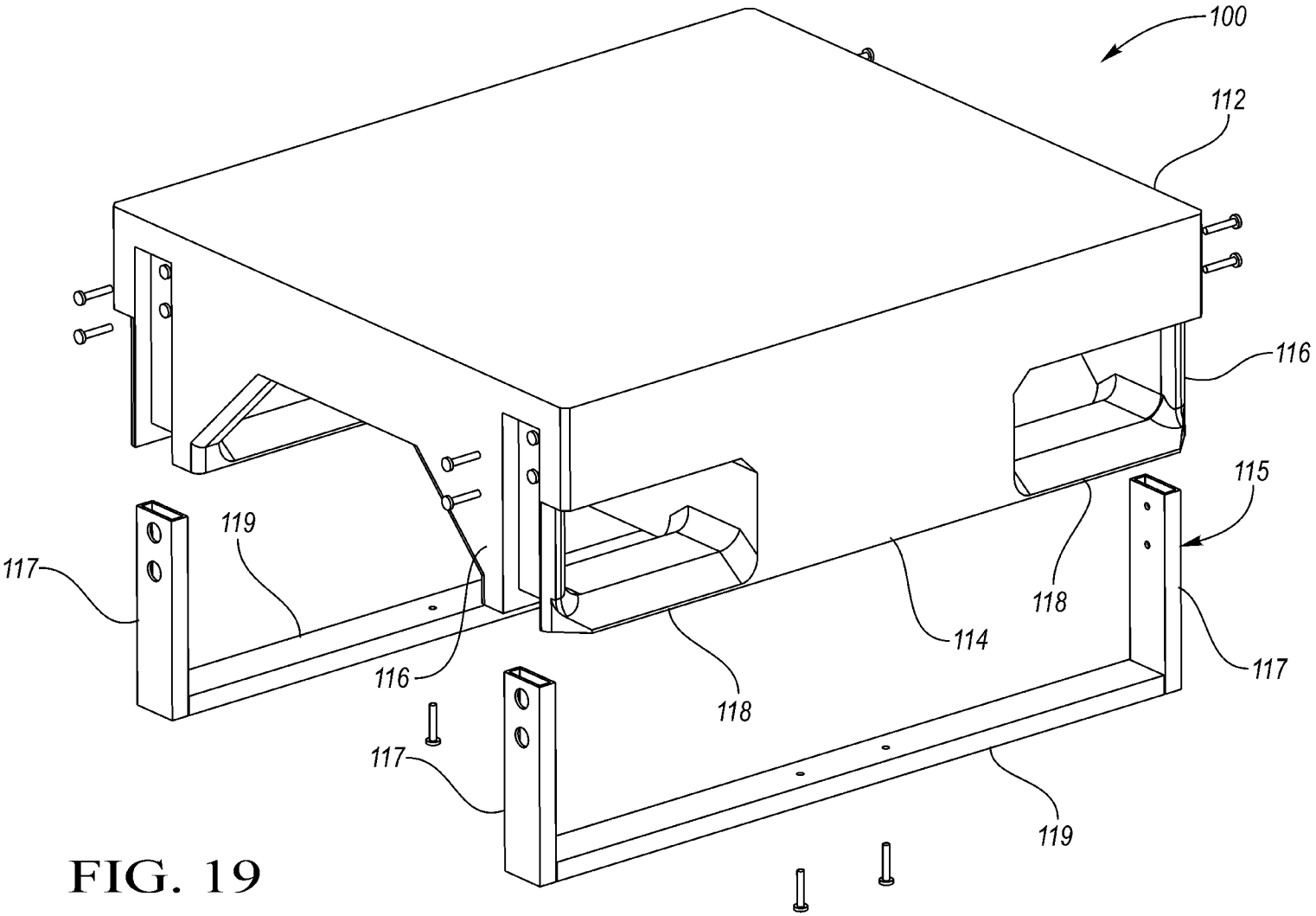
FIG. 19 is an exploded view of the pallet.
Figure 20:
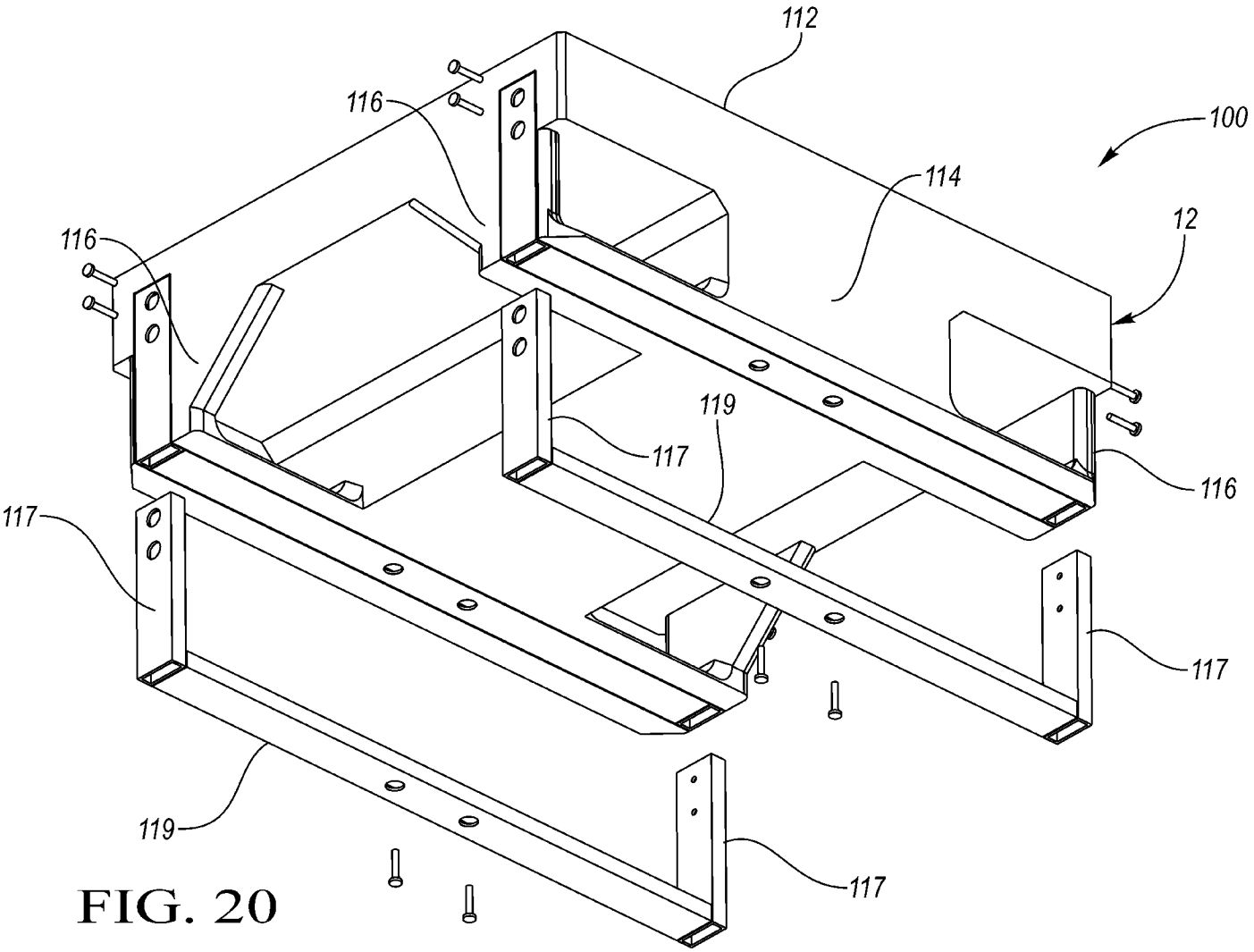
FIG. 20 is a bottom perspective of the exploded view of the pallet of FIG. 19.

Referring to FIGS. 19 and 20, the reinforcement members 115 may each include a pair of vertical members 117 and a cross member 119 connecting lower ends of the vertical members 117. The vertical members 117 may be tubular and may have a rectangular cross section. The lower ends of the vertical members 117 may contact the floor (i.e. cross member 119 is between the lower ends of the vertical members 117, not below them) to provide additional stability to the pallet 100.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A collapsible container comprising:

a base;

a pair of opposed side walls pivotably connected to the base and movable between an upright position and a collapsed position on the base;

a rear wall pivotably connected to the base and movable between an upright position and a collapsed position on the base, the rear wall including a pair of opposed flange portions with a lower central portion therebetween, wherein the lower central portion is less than half a height of the flange portions; and a front wall pivotably connected to the base opposite the rear wall, wherein the front wall is movable between an upright position and a retracted position outward of the container.

2. The collapsible container of claim 1 wherein the front wall and the base are configured to prevent the front wall from being pivoted inwardly into the container.

3. The collapsible container of claim 1 wherein each of the base, side walls, rear wall and front wall is injection molded as a single piece of plastic.

4. The collapsible container of claim 3 wherein each of the side walls includes at least one side reinforcement member, wherein the at least one side reinforcement member is of a material different from that of the side walls.

5. The collapsible container of claim 4 wherein the base includes at least one base reinforcement member of a material different from that of the base.

6. The collapsible container of claim 1 wherein the front wall has a height that is less than one-third a height of the side walls.

7. The collapsible container of claim 1 further including a pair of opposed side flanges projecting upwardly from side edges of the base and integrally molded with the base, wherein the side walls are pivotably connected to the side flanges and wherein the front wall is selectively latched to the side flanges.

8. A plurality of the collapsible container of claim 1 symmetrically stacked on one another.

9. The plurality of stacked collapsible containers of claim 8 in combination with a pallet, wherein the plurality of stacked collapsible containers are stacked on the pallet.

10. The combination of claim 9 further in combination with a plurality of plastic milk containers filling each of the plurality of collapsible containers.

11. The combination of claim 10 wherein the plurality of plastic milk containers can be removed over the front wall from a lower one of the plurality of collapsible containers on which an upper one of the plurality of collapsible containers is stacked.

12. A collapsible container comprising:

a base;

a pair of opposed side walls pivotably connected to the base and movable between an upright position and a collapsed position on the base;

a rear wall pivotably connected to the base and movable between an upright position and a collapsed position on the base, the rear wall including a pair of opposed flange portions with a lower central portion therebetween; and a front wall pivotably connected to the base opposite the rear wall, wherein the front wall is movable between an upright position and a retracted position outward of the container, wherein the front wall in the upright position is substantially flush with the side walls in the collapsed position.

13. The collapsible container of claim 12 wherein the front wall is configured to prevent the front wall from being pivoted inwardly of into the container.

14. The collapsible container of claim 13 wherein each of the base, side walls, rear wall and front wall is injection molded as a single piece of plastic.

15. The collapsible container of claim 14 wherein each of the side walls includes at least one side reinforcement member, wherein the at least one side reinforcement member is of a material different from that of the side walls.

16. The collapsible container of claim 14 wherein the base includes at least one base reinforcement member of a material different from that of the base.

17. The collapsible container of claim 14 wherein the front wall has a height that is less than one-third a height of the side walls.

18. A collapsible container comprising:

a base;

a pair of opposed side flanges projecting upwardly from side edges of the base and integrally molded with the base;

a pair of opposed side walls pivotably connected to the side flanges and movable between an upright position and a collapsed position on the base;

a rear wall pivotably connected to the base and movable between an upright position and a collapsed position on the base, the rear wall including a pair of opposed flange portions with a lower central portion therebetween; and a front wall pivotably connected to the base opposite the rear wall, wherein the front wall is movable between an upright position and a retracted position outward of the container and wherein the front wall is selectively latched to the side flanges.

19. The collapsible container of claim 18 wherein the front wall is configured to prevent the front wall from being pivoted inwardly of into the container.

20. The collapsible container of claim 19 wherein each of the base, side walls, rear wall and front wall is injection molded as a single piece of plastic.

21. The collapsible container of claim 20 wherein each of the side walls includes at least one side reinforcement member, wherein the at least one side reinforcement member is of a material different from that of the side walls.

22. The collapsible container of claim 21 wherein the base includes at least one base reinforcement member of a material different from that of the base.

23. The collapsible container of claim 22 wherein the front wall has a height that is less than one-third a height of the side walls.

* * * * *